United States Patent [19]

Cassidy et al.

[11] Patent Number: 4,945,588

[45] Date of Patent: Aug. 7, 1990

[54] AIR/WATER MATTRESS AND INFLATION APPARATUS

[75] Inventors: Daniel G. Cassidy, Findlay; Roger J. Koch, Ottawa, both of Ohio

[73] Assignee: Kuss Corporation, Findlay, Ohio

[21] Appl. No.: 403,699

[22] Filed: Sep. 6, 1989

[51] Int. Cl.[5] ..... A47C 27/08

[52] U.S. Cl. ..... 5/451; 5/453; 5/457

[58] Field of Search ..... 5/449–451, 5/453, 455, 456, 457

[56] References Cited

U.S. PATENT DOCUMENTS

| | | | |
|---|---|---|---|
| 3,456,270 | 7/1969 | Weinstein et al. | 5/451 |
| 3,477,071 | 11/1969 | Emerson | 5/456 X |
| 3,803,647 | 4/1974 | Reswick | 5/450 |
| 4,169,295 | 10/1979 | Darling | 5/450 |
| 4,309,783 | 1/1982 | Cammack et al. | 5/453 X |
| 4,394,784 | 7/1983 | Swenson et al. | 5/453 |
| 4,558,476 | 12/1985 | Linder | 5/450 |
| 4,727,607 | 3/1988 | Nystad | 5/450 |
| 4,829,616 | 5/1989 | Walker | 5/455 X |

*Primary Examiner*—Michael F. Trettel

*Attorney, Agent, or Firm*—Willian Brinks Olds Hofer Gilson & Lione

[57] ABSTRACT

An inflation system for a mattress having a lower, water chamber and a coextensive upper, air chamber includes a pair of opposed blowers, a solenoid air valve, both manual and pressure activated switches and control circuitry for activating and deactivating the blowers in response to pressure within the air chamber sensed by the pressure switch or manual commands. The air/water mattress and inflation system of the present invention is suitable for long term care bedridden patients which have a tendency to develop decubitus ulcers and further facilitates entry, repositioning and egress from the water mattress when the air chamber is inflated.

19 Claims, 3 Drawing Sheets

AIR/WATER MATTRESS AND INFLATION APPARATUS

BACKGROUND OF THE INVENTION

The invention relates generally to mattresses having two horizontally coextensive chambers for air and water and more particularly to an air and water mattress and inflation apparatus which facilitates entry, repositioning and egress from the mattress.

Flotation sleep products have advanced from their beginnings wherein a relatively unstable elastomeric bladder was filled with water to support a person with varying degrees of comfort. Nearly every aspect of this product has been improved in the last three decades. The use of leak-proof, long life materials, improved seals, weight reduction and oscillation damping are the more significant areas of improvement.

One of the inherent benefits of water filled recumbent supports is the relatively low and uniform pressure applied to the tissue of a human body when supported thereby. Such relatively low and uniform pressure interferes only negligibly with surface adjacent circulation in the skin and body tissue. By contrast, circulation is diminished or temporarily curtailed due to the compression of blood vessels and tissue with conventional mattresses. Such improved circulation greatly reduces the incidence of decubitus ulcers and generally improves the circulation of bedridden patients.

The improved circulation of patients and the reduced incidence of decubitus ulcers is not without certain drawbacks. Perhaps the most significant is the difficulty attendant entry and egress from such a water mattress. Those familiar with water mattresses will attest to the difficulties encountered in rising to ones feet from a water mattress of conventional design. This is a particularly significant problem with infirm patients requiring hospital care. This general difficulty is coupled with a complication. Generally speaking, hospital beds position a patient several inches above the surface of a conventional, residential bed for numerous reasons relating to medical treatment, hygiene and patient comfort. Entry and egress from such a raised surface water mattress can present a nearly insurmountable problem for many patients. The alternative, of course, is to require assistance to enter or exit the water mattress which represents one additional responsibility for typically overworked nursing and orderly staffs.

Attempts have been made to solve this difficulty. For example, U.S. Pat. No. 3,456,270 discloses a flotation apparatus wherein a contoured support contains a water filled mattress and an adjustably filled air bladder positioned thereover. The air bladder includes transversely oriented chambers having equal cross sections. The air bladder extends from the head of the patient along the torso but does not support the lower legs.

U.S. Pat. No. 3,803,647 teaches a similar device. In the flotation bed disclosed in this patent, water is replaced by a fluid having a specific gravity substantially greater than one and preferably about two. This device also includes an inflatable bladder which may either be disposed below the fluid to raise the level of the supporting fluid when inflated or on top of the fluid to function as the support for the patient. In the latter configuration, the air chamber comprises a plurality of longitudinally oriented chambers. Air pressure is provided from an external air pump.

It is apparent from the foregoing that improvements in the art of water mattresses and particularly those including coextensive superposed air chambers for patient use are both possible and desirable.

SUMMARY OF THE INVENTION

The invention relates generally to an air inflation system for a mattress having a lower, water chamber and a coextensive upper, air chamber disposed in a rigid surround having sidewalls and a bottom. An inflation apparatus includes a pair of opposed fill and exhaust blowers, a solenoid operated air valve, both pressure activated and manual switches and control circuitry for activating and deactivating the blowers to fill and exhaust air from the upper, air chamber of the mattress. When inflated, the mattress becomes relatively rigid, thereby facilitating patient movement onto, about and off the mattress. Proper air pressure is achieved and maintained by the pressure switch which initially terminates the fill cycle and cycles the fill blower to maintain proper pressure. When the air chamber is evacuated, the support provided by the air/water mattress is like that offered by a conventional water mattress. The air/water mattress and inflation apparatus of the present invention is suitable for long term care of bedridden patients which have a tendency to develop decubitus ulcers.

DESCRIPTION OF THE PREFERRED EMBODIMENT

Figure 1:
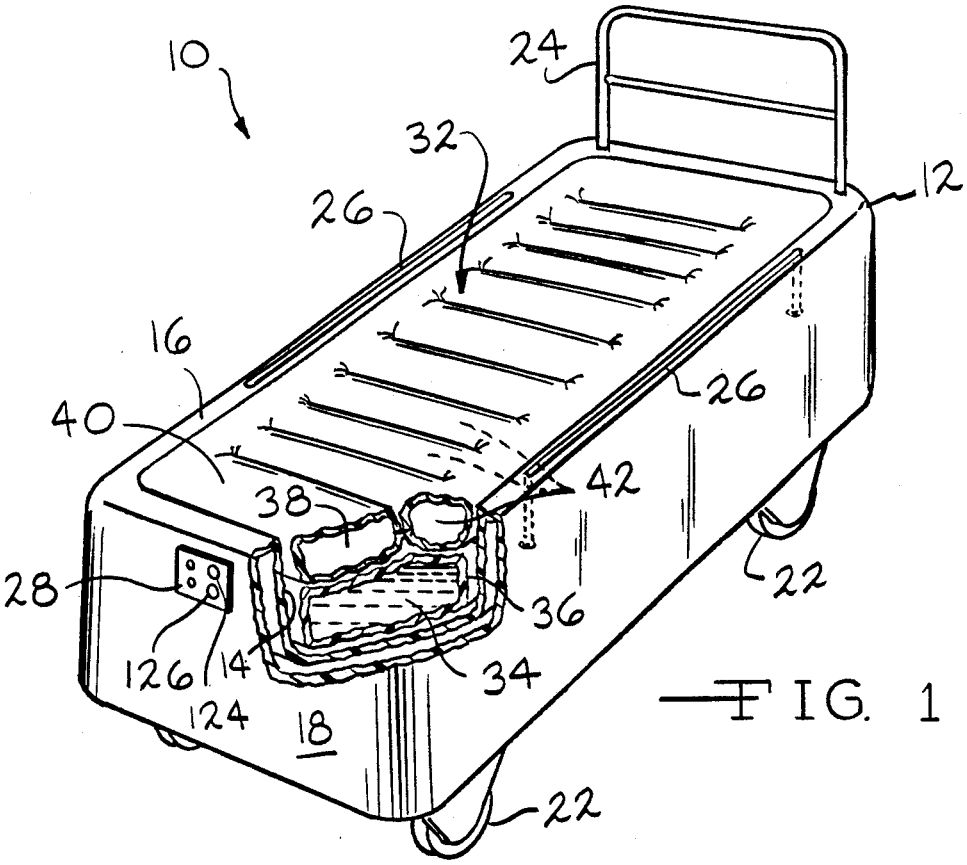
FIG. 1 is a perspective view with portions broken away of an air/water mattress incorporating a fill and control apparatus according to the present invention.

Referring now to FIG. 1, an air/water mattress and inflation apparatus according to the present invention is illustrated and generally designated by the reference numeral 10. The apparatus 10 includes a generally elongate relatively rigid housing 12 defining a re-entrant region 14, an outwardly extending horizontal ledge 16 and sidewalls 18. The housing 12, which may be fabricated of any lightweight durable material such as fiberglass reinforced plastic, is preferably disposed upon a plurality of casters 22 which facilitate transport, movement and repositioning of the apparatus 10 as will be readily appreciated. Extending upwardly from the ledge 16 at one end of the housing 12, nominally designated the head, is a guard and handle structure 24 which facilitates movement of the apparatus 10. Extending through the ledge 16 and along each of the longer sidewalls 18 is a restraining rail 26. The restraining rails 26 are illustrated in their retracted position but may be raised and maintained several inches above the ledge 16 to ensure that patients remain safely upon the apparatus 10. At the end of the housing 12 opposite the guard and handle structure 24, i.e., the foot, and positioned upon the sidewall 18 is a control panel 28. The control panel 28 includes various switches and indicators which will be more fully described subsequently.

Figure 2:
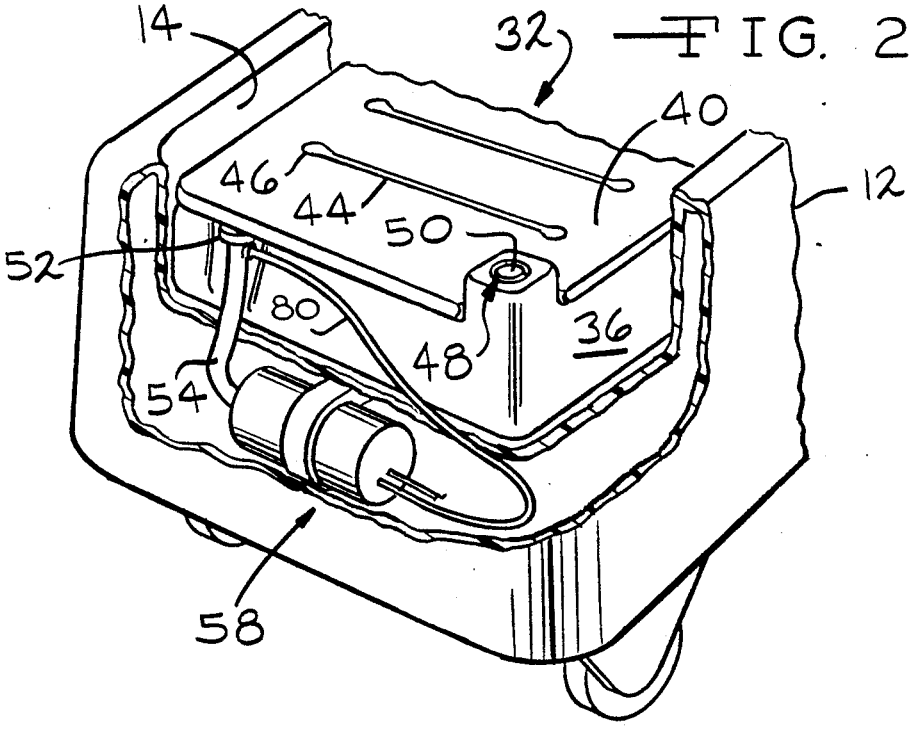
FIG. 2 is an enlarged, perspective view of an air/water mattress and fill and control apparatus according to the present invention.

Referring now to FIGS. 1 and 2, it will be understood that received within the re-entrant region 14 of the housing 12 is a dual chamber mattress assembly 32. The length and width of the mattress assembly 32 are sufficient to receive an adult person in a prone position. The mattress assembly 32 includes a first, lower water chamber 32 defined by a surrounding membrane 36 of polyvinyl chloride (PVC) or other suitable material having similar water retaining, flexibility and service life characteristics. Disposed directly above the lower water chamber 34 and coextensive therewith is a second, upper air chamber 38 defined by a second surrounding membrane 40 of polyvinyl chloride (PVC) or similar material. The air chamber 38 is subdivided into a plurality of transversely extending tubes 42 defined by a plurality of transverse seals 44. The seals 44 which extend across only the central portion of the air chamber 38 define enlarged teardrop shaped terminal regions 46 which disperse and diffuse forces transmitted through the membrane 40 and acting upon the transverse seals 44, particularly their ends and thereby improve the service life of the mattress assembly 32.

Extending through the membrane 36 and into the water chamber 34 is a water fill assembly 48 including a removable closure 50 which selectively provides access to the lower water chamber 34 for filling and emptying it. Likewise, an access opening 52 extends through the membrane 40 and into the air chamber 38. Coupled to the access opening 52 is a flexible hose or conduit 54 which provides fluid communication between the air chamber 38 and the fill and evacuate assembly 58.

Figure 3:
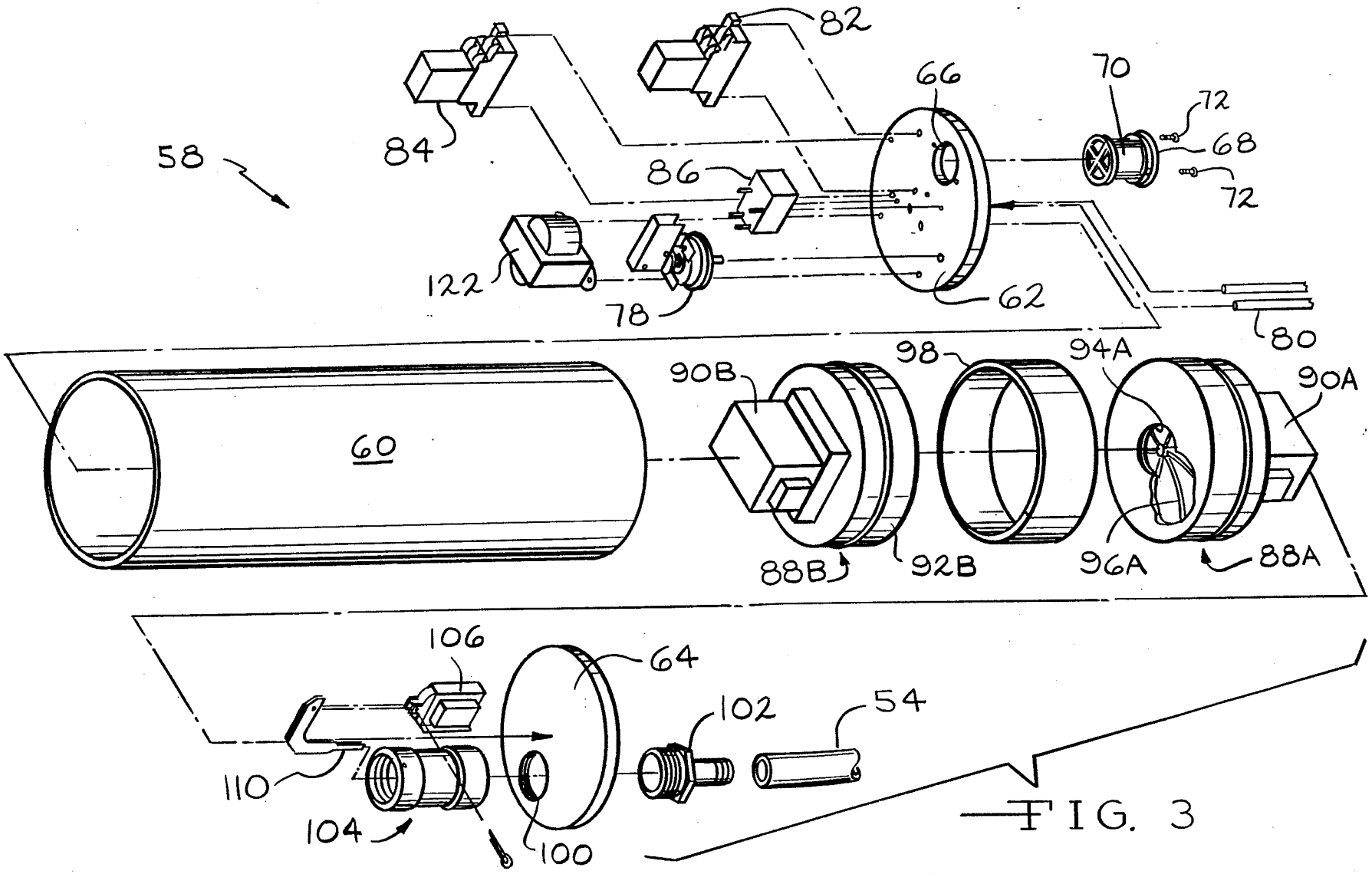
FIG. 3 is an enlarged and exploded perspective view of the air fill and evacuation system components of an air/water mattress according to the present invention.

Turning now to FIG. 3, the fill and evacuate assembly 58 is illustrated. The assembly 58 is disposed within an elongate cylindrical housing 60. The housing 60 is closed at both ends by circular disks 62 and 64. The circular disk 62 includes a through aperture 66 which receives a cylindrical basket type air filter 68. The air filter 68 includes filter media 70 secured on both its inside and outside faces such that flow in either direction will not dislodge the filter media 70 and permit unfiltered air to pass therethrough. The filter 68 is removably secured by suitable threaded fasteners 72. The disk 62 supports various control components such as a normally closed pressure sensing switch 78 which is coupled to a pressure sensing line 80 and other components such as relays 82, 84 and 86. The pressure sensing line 80 is in fluid communication with the flexible hose or conduit 54 near the air chamber 38.

The seal-to-seal 44 spacing is non-uniform. The distance between the seals 44 and thus the volume of the tubes 42 is generally proportional to the weight of the portion of the patient supported thereby. For example, the seal-to-seal spacing under the middle (torso) portion may be 10 inches whereas at the lower (foot) portion it may be 6 inches. Accordingly, the pressure switch 78 senses the air pressure in the air chamber 38.

Centrally disposed within the housing 60 are a pair of opposed electric motor and blower assemblies 88A and 88B. The motor and blower assembly 88A fills or inflates the air chamber 38 whereas the assembly 88B exhausts or deflates the air chamber 38. Each of the assemblies 88A and 88B are identical and includes an electric motor 90A and 90B, respectively, secured to a generally cylindrical housing 92A and 92B, respectively. The housing 92A defines an inlet 94A leading to a fan 96A. The fan 96A is driven by the electric motor 90A. The assembly 88B includes corresponding components which are not illustrated. As illustrated, the two assemblies 88A and 88B are arranged in opposition such that the openings 94A and 94B and the fans 96A and 96B face one another. Accordingly first of all when one or the other of the assemblies 88A or 88B, and specifically the electric motors 90A or 90B is activated, one end of the housing 60 is at reduced pressure and draws in air whereas the other end is at elevated pressure and exhausts air. When the other assembly 88A or 88B is energized, the reverse action occurs. It will be apparent that the air driven by the energized assembly 88A or 88B passes through the unenergized assembly and that the fan of the unenergized assembly 88A or 88B will freewheel. An annulus 98 fabricated of a resilient material seals the region between the motor and blower assemblies 88A and 88B and the housing 60.

Figure 4:
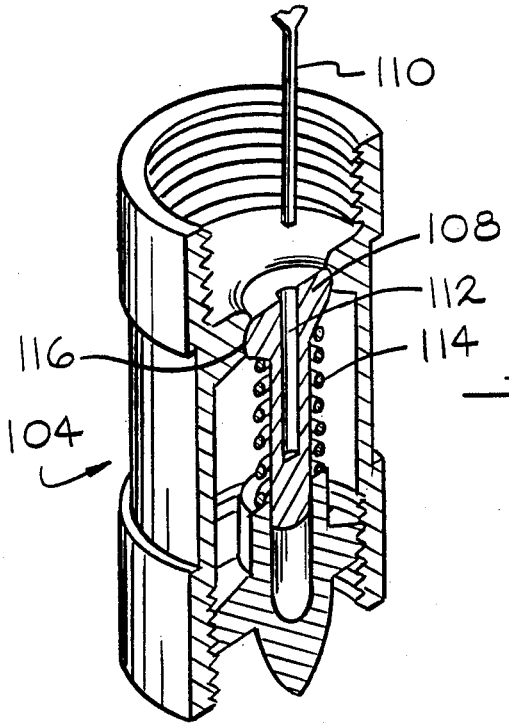
FIG. 4 is an enlarged, sectional view of a check valve and operator assembly of an air/water mattress according to the present invention.

Referring now to FIGS. 3 and 4, the circular disk 64 at the other end of the housing 60 defines a through aperture 100 which receives a fitting 102 coupled to the conduit or flexible pipe 54 communicating with the air chamber 38 of the mattress assembly 32. The fitting 102 is coupled to a check valve assembly 104. The check valve assembly 104 includes a solenoid 106. The solenoid 106 is coupled to the plunger 108 of the check valve assembly 104 through an arm 110. The arm 110 is received within a blind axially disposed passageway 112 within the plunger 108 of the check valve assembly 104. A compression spring 114 is disposed axially about the plunger 108 and maintains it in sealed relationship with the valve seat 116 of the check valve assembly 104 as will be readily appreciated. When the solenoid 106 is activated, the plunger 108 translates axially and permits the flow of air through the check valve assembly 104. The check valve 104, and specifically the plunger 108, are arranged such that pressure from the air within the air chamber 38, communicated through the flexible pipe or hose 54, attempts to close the check valve assembly 104 and assists the spring 114 in doing so.

Figure 5:
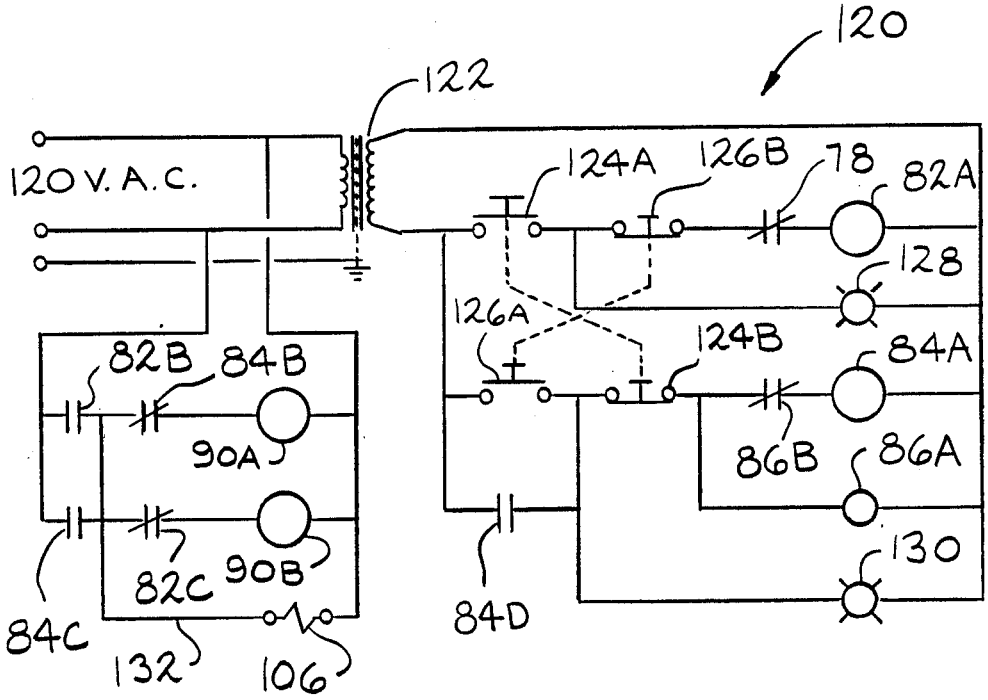
FIG. 5 is a schematic diagram of the electrical circuit of a air fill and evacuation apparatus according to the present invention.

Turning now to FIGS. 1, 3 and 5, the apparatus 10 also includes control circuitry 120 which controls the inflation and evacuation of the air chamber 38. The control circuitry 120 includes a step-down transformer 122 which provides twenty-four volts across its secondary winding. This low voltage is utilized for the majority of the control circuitry 120 inasmuch as it represents a negligible shock hazard. One side of the twenty-four volt secondary is coupled to a normally open contact 124A of a maintained contact, double pole, single throw inflate switch 124. The same low voltage line is connected to normally open contacts 126A of a momentary contact, double pole, single throw deflate switch 126. The maintained contact, double pole, single throw inflate switch 124 also includes normally closed contacts 124B. The contacts 124B are ganged with and operate with the contacts 124A. The contacts 124B are connected in series with the contacts 126A. The momentary contact, double pole, single throw deflate switch 126 also includes normally closed contacts 126B. The contacts 126B are ganged and operate with the contacts 126A. The contacts 126B are connected in series with the contacts 124A.

An indicator lamp 128, which is preferably red, is coupled between the switch contacts 124A and 126B and the return side of the power transformer 122. Similarly, a second indicator lamp 130 is coupled between the switch contact 126A and 124B and the return side of the transformer 122. The normally closed pressure sensing switch 78 and its electrical contacts are coupled between the normally closed switch contacts 126B and the coil 82A of a first control relay 82. Similarly, the coil 84A of a second control relay 84 is coupled between the normally closed contacts 86B of a time delay relay 86 and the transformer return line. The normally closed contacts 86B of the time delay relay 86 are coupled between the switch contacts 124B and the coil 84A of the second control relay 84.

The first control relay 82 also includes a first pair of normally open contacts 82B which are disposed in series with a first pair of normally closed contacts 84B in series with the fill motor 90A. Similarly, the second control relay 84 includes a first pair of normally open contacts 84 in series with a first pair of normally closed contacts 82C of the first control relay 82 which are also in series with the second, exhaust motor 90B. Coupled to one side of all the pairs of contacts is a line 132 which connects the coil of the solenoid 106 to the power line. Lastly, the second control relay 84 includes a second pair of normally open contacts 84D disposed in parallel with the pair of normally open switch contacts 126A.

In operation, the switch 124 and the switch contacts 124A and 124B may be activated. Once activated, the switch 124 and the contacts 124A and 124B are maintained in the activated position. Similarly, the pressure switch 78 is closed and the first control relay 82 is activated. The second control relay 84 remains deactivated. Accordingly, both the fill blower motor 90A and the solenoid 106 are activated. The air chamber 38 is filled until either the switch contacts 124A and 124B are opened manually or the pressure switch 78 interrupts operation of the control relay 82 and thus the fill blower motor 90A and the solenoid 106. Proper air pressure in the air chamber 38 is approximately 1 p.s.i. The indicator lamp 128 is activated during this time. If air pressure in the air chamber 38 falls below pressure threshold of the pressure switch 78, the pressure switch 78 will close, once again activating the relay 82, the fill blower motor 90A and the solenoid 106.

To deflate the air chamber 38, the switch 124 and the contacts 124A and 124B are deactivated. Then, the momentary contact deflate switch 126 and the contacts 126A and 126B are activated. Accordingly, the second control relay 84 and the coil 84A are activated, closing the contacts 84C while opening the contacts 84B and thus activating the second, exhaust blower motor 90B and the solenoid 106. Air from the air chamber 38 is withdrawin. The evacuation cycle is terminated by the action of the time delay relay 86. Typically, the delay is on the order of one minute. The contacts 84B open after a preselected time and power to the second control relay coil 84 is terminated. Hence, the second, exhaust blower motor 90B and the solenoid 106 are deactivated.

The foregoing disclosure is the best mode devised by the inventors for practicing this invention. It is apparent, however, that apparatus incorporating modifications and variations will be obvious to one skilled in the art of air/water mattresses and control systems therefor. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. In a mattress defining a first, lower chamber for water and a second, upper chamber for air, the improvement comprising, an apparatus for filling and exhausting air from said upper chamber, said apparatus including a housing, a pair of motor and blower assemblies disposed in opposed juxtaposition within said housing, control means for alternately and exclusively energizing one of said pair of motor and blower assemblies, said control means including a first, inflate switch, a second, deflate switch, and a pressure switch for sensing the pressure of air within said second, upper chamber.

2. The improvement of claim 1 wherein said first, inflate switch is a maintained contact type.

3. The improvement of claim 1 wherein said second, deflate switch is momentary contact type.

4. The improvement of claim 1 further including a time delay means for terminating deflation of said air chamber after approximately one minute.

5. The improvement of claim 1 wherein said control means includes a stepdown transformer having a low voltage secondary of about 24 V.A.C.

6. The improvement of claim 1 wherein said pair of motor and blower assemblies deliver air at a pressure of about 1 p.s.i.

7. The improvement of claim 1 further including filter means disposed in said housing for filtering air entering said housing.

8. The improvement of claim 1 further including a solenoid operated valve disposed between said pair of motor and blower assemblies and said second, upper chamber for air.

9. An apparatus for supporting human beings comprising, in combination, a mattress having a lower, water chamber, an upper, air chamber and a selectively removable closure for gaining access to said water chamber, a fluid conduit communicating with said air chamber, a blower assembly including a housing, a pair of blowers disposed in opposed juxtaposition within said housing, and a control assembly including an inflate switch, a deflate switch, a pressure switch for sensing the pressure of air within said air chamber and terminating operation of one of said blowers when the air pressure within said air chamber reaches a preselected air pressure and a time delay means for terminating operation of the other of said blower assemblies after a predetermined period of time.

10. The apparatus of claim 9 wherein said fluid conduit provides communication between said air chamber and said housing.

11. The apparatus of claim 9 wherein said air chamber is coextensive with said water chamber.

12. The apparatus of claim 9 wherein said inflate switch is a maintained contact type switch.

13. The apparatus of claim 9 wherein said deflate switch is a momentary contact type switch.

14. The apparatus of claim 9 wherein said air chamber is divided into a plurality of smaller transverse chambers by transverse seals.

15. The apparatus of claim 9 wherein said air chamber is divided by a plurality of transverse seals into air tubes, said air tubes having an inflated volume related to the weight of the human being supported thereby.

16. The apparatus of claim 9 wherein said air chamber includes a plurality of transverse seals having enlarged terminal portions.

17. The apparatus of claim 9 further including a solenoid operated valve disposed between said pair of motor and blower assemblies and said second, upper chamber for air.

18. An apparatus for supporting human beings in a prone position, comprising, in combination, a mattress having a lower, water chamber, a coextensive upper, air chamber and a selectively removable closure for gaining access to said water chamber, a fluid conduit communicating with said air chamber, a blower assembly including a housing, a pair of blowers disposed in opposed juxtaposition within said housing, a control assembly including an inflate switch, a deflate switch, a pressure switch for sensing the pressure of air within said air chamber and terminating operation of one of said blowers when the air pressure within said air chamber reaches a preselected air pressure and a time delay means for terminating operation of the other of said blower assemblies after a predetermined period of time; and a solenoid operated valve between the interior of said housing and said fluid conduit.

19. The apparatus of claim 18 wherein said air chamber is divided by a plurality of transverse seals into air tubes, said air tubes having an inflated volume related to the weight of the human being supported thereby.

* * * * *